United States Patent [19]

Rabitsch

[11] 4,277,029

[45] Jul. 7, 1981

[54] IRRIGATION SPRINKLER

[76] Inventor: Benjamin F. Rabitsch, P.O. Box 1062, Millen, Ga. 30442

[21] Appl. No.: 100,692

[22] Filed: Dec. 3, 1979

[51] Int. Cl.[3] ..... B05B 3/04; B05B 3/08

[52] U.S. Cl. ..... 239/232; 239/236; 239/240; 239/513; 239/DIG. 1

[58] Field of Search ..... 239/232, 236, 240, DIG. 1, 239/511, 513

[56] References Cited

U.S. PATENT DOCUMENTS

| | | | |
|---|---|---|---|
| 1,637,413 | 8/1927 | Elder | 239/232 |
| 2,654,635 | 10/1953 | Lazzarini | 239/DIG. 1 |
| 2,780,488 | 2/1957 | Kennedy | 239/DIG. 1 |
| 3,261,552 | 7/1966 | Hunter | 239/236 |
| 3,952,954 | 4/1976 | Taylor | 239/DIG. 1 |

*Primary Examiner*—Andres Kashnikow

*Attorney, Agent, or Firm*—Harvey B. Jacobson

[57] ABSTRACT

A sprinkler for irrigating a square or other polygonally-shaped land area with the sprinkler including a unique structure which will accurately distribute an equal quantity of water on each increment of land area being irrigated. The sprinkler includes a rotatable nozzle in which the speed of the nozzle is varied by a gear drive mechanism which receives its power from a water powered turbine device. The rotational speed of the nozzle is slower when irrigating corner area of the land area being irrigated and faster when irrigating intermediate straight-sided portions of the land area with the nozzle including a diffuser which becomes operative to reduce the length of trajectory of the water being discharged when the sprinkler is irrigating the intermediate straight-sided portions of the land area being irrigated.

8 Claims, 7 Drawing Figures

FIG. 4
FIG. 2
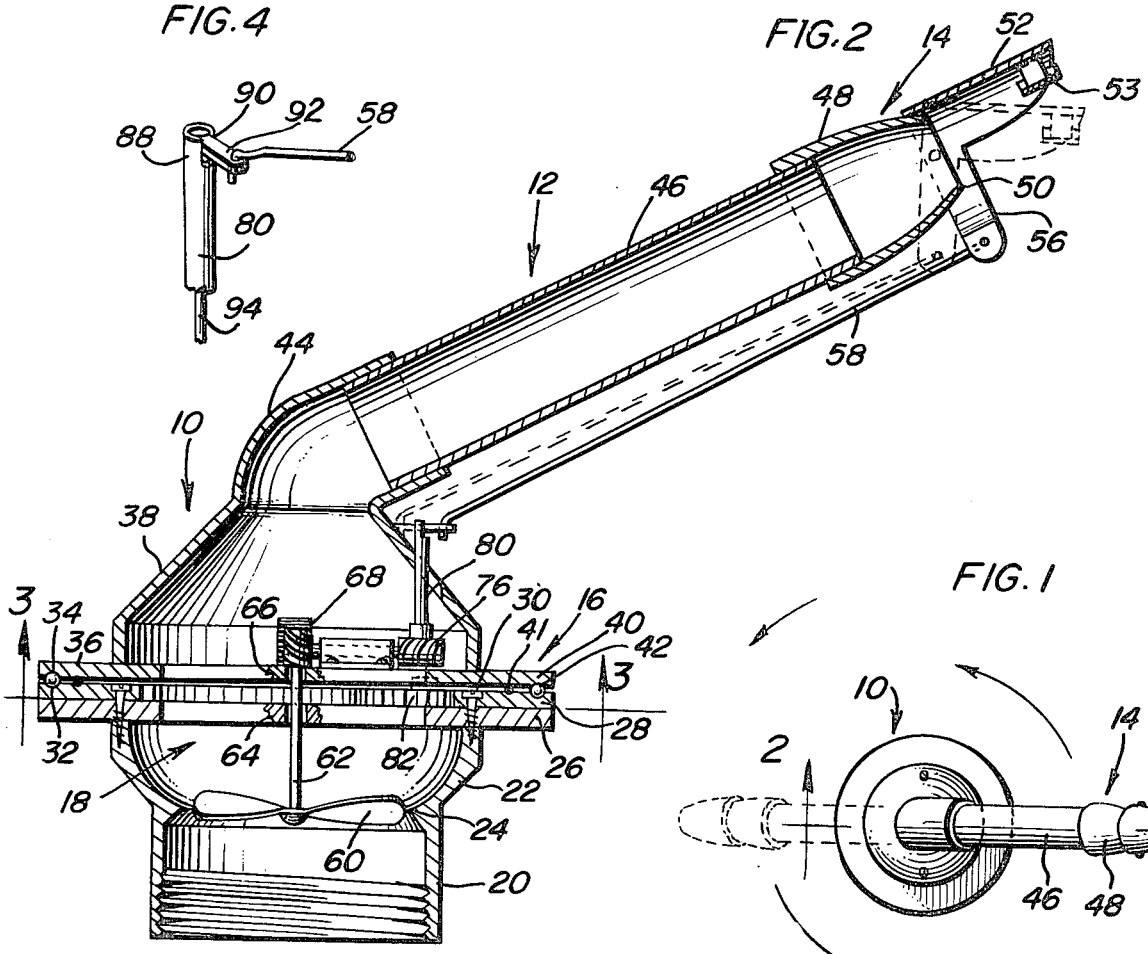
FIG. 1
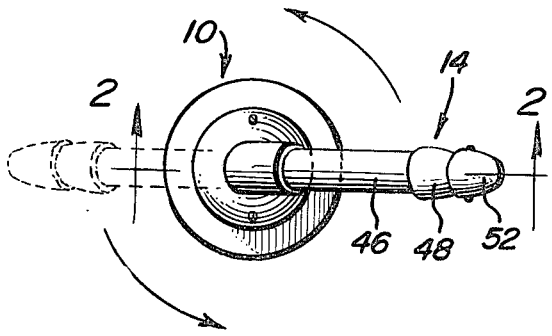
FIG. 3
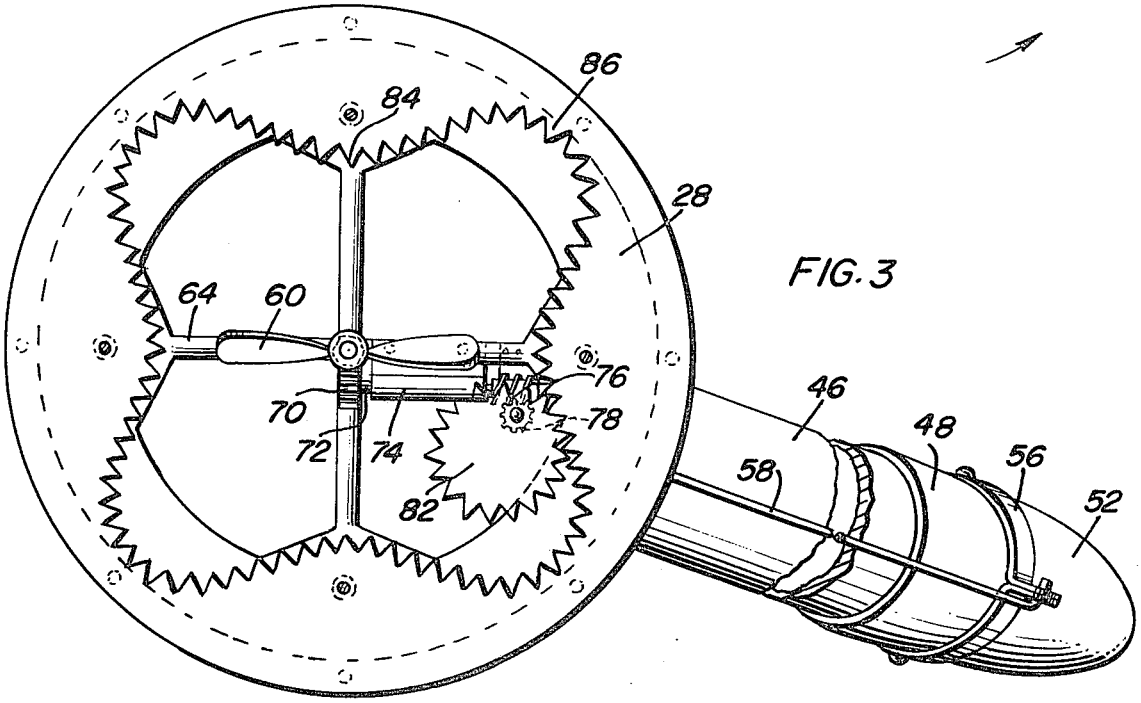

IRRIGATION SPRINKLER

BACKGROUND OF THE INVENTION

1. Field of the Invention

The present invention generally relates to a sprinkler for irrigation of a square or other polygonal land area which includes a nozzle discharging water in a lateral direction as the nozzle rotates about a substantially vertical axis. A water powered drive mechanism including a unique gear arrangement causes variation in the speed of rotation of the nozzle with the nozzle moving at a relatively slow rate of speed when irrigating corner areas of the land area and at a higher rate of speed when irrigating the intermediate straight-sided portions of the land area. The nozzle includes a diffuser structure to reduce the length of trajectory of the water when irrigating the straight-sided portions of the land area with the diffuser being actuated by the drive mechanism.

2. Description of Relevant Art

Sprinklers for irrigating large land areas have been utilized for many years with various arrangements being provided to distribute water in a desired pattern. Sprinkling devices are generally categorized as stationary permanently set sprinklers or movable sprinklers. Stationary sprinklers include structure which utilize underground or above ground supply pipes having one or more discharge nozzles connected therewith. Movable sprinklers include travelling sprinklers either of the linear or center pivot type driven by water power, electrical power, and the like. One of the problems which has existed is the discharge of an equal quantity of water onto all increments of the land area being irrigated. For example, irrigation sprinklers utilizing rotatable nozzles or elongated pipes and nozzles rotating about a center pivot will accurately irrigate a circular area but inadequately irrigate the corner portions of a square or polygonal area. Many efforts have been made to vary the circular pattern of a rotating nozzle such as by changing the angle of discharge from the nozzle, varying the pressure and thus volume being discharged at particular areas by various means such as cams, electrical devices and the like. While such devices have worked effectively in some instances, they are usually complicated thus requiring considerable maintenance and subject to failure and quite expensive to install and operate.

SUMMARY OF THE INVENTION

An object of the present invention is to provide an irrigation sprinkler for irrigating a square or other polygonal land area by using a centrally located rotatable nozzle with a drive mechanism for the nozzle varying the rotational speed thereof so that all increments of the land area will receive the same quantity of water.

Another object of the invention is to provide an irrigation sprinkler in accordance with the preceding object which includes a water powered drive gear mechanism for rotating the nozzle with the drive gear mechanism including a constant speed input and an output which rotates the nozzle at a slower speed when irrigating the portion of the land area in alignment with the corners of the land area and increases the speed so that the nozzle is rotating at a maximum speed when irrigating the land area in alignment with the center of the straight sides of the land area.

A further object of the invention is to provide an irrigation sprinkler in accordance with the preceding objects in which the nozzle is provided with a diffuser to shorten the trajectory path of the water being discharged when irrigating the portion of the land area spaced from the corner areas so that the water will be discharged only on the desired land area to be irrigated with all areas of the land area receiving the same quantity of water.

Yet another object of the invention is to provide an irrigation sprinkler in accordance with the preceding objects in which the drive mechanism includes a gear having the shape and configuration of the land area with high points on the drive gear corresponding to corners of the land area with the nozzle including a rotatable shaft mounted thereon with an eccentric gear engaging the polygonal drive gear so that the rotational speed of the eccentrically supported gear, its supporting shaft and the nozzle will decrease as the rotational axis of the eccentric gear approaches the periphery of the square or polygonal drive gear as the eccentric gear rolls around the corners of the drive gear.

Still another object of the present invention is to provide an irrigation sprinkler in accordance with the preceding objects which is quite simple in construction, requires no external power source, substantially maintenance free and accurate in depositing an equal quantity of water on all increments of a square or polygonal land area being irrigated.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a schematic top plan view illustrating the structure of the irrigation sprinkler of the present invention.

FIG. 2 is a vertical sectional view, on an enlarged scale, taken substantially upon a plane passing along section line 2—2 on FIG. 1 illustrating the specific structure of the rotating nozzle and the drive mechanism therefor.

FIG. 3 is a transverse, sectional view taken substantially upon a plane passing along section line 3—3 of FIG. 2 illustrating the internal gear carried by the nozzle and the eccentric drive gear and the water powered device for actuating the drive gear.

FIG. 4 is a fragmental perspective view illustrating the drive structure for operating the diffuser at the outer end of the nozzle.

DESCRIPTION OF THE PREFERRED EMBODIMENTS

Figure 5:
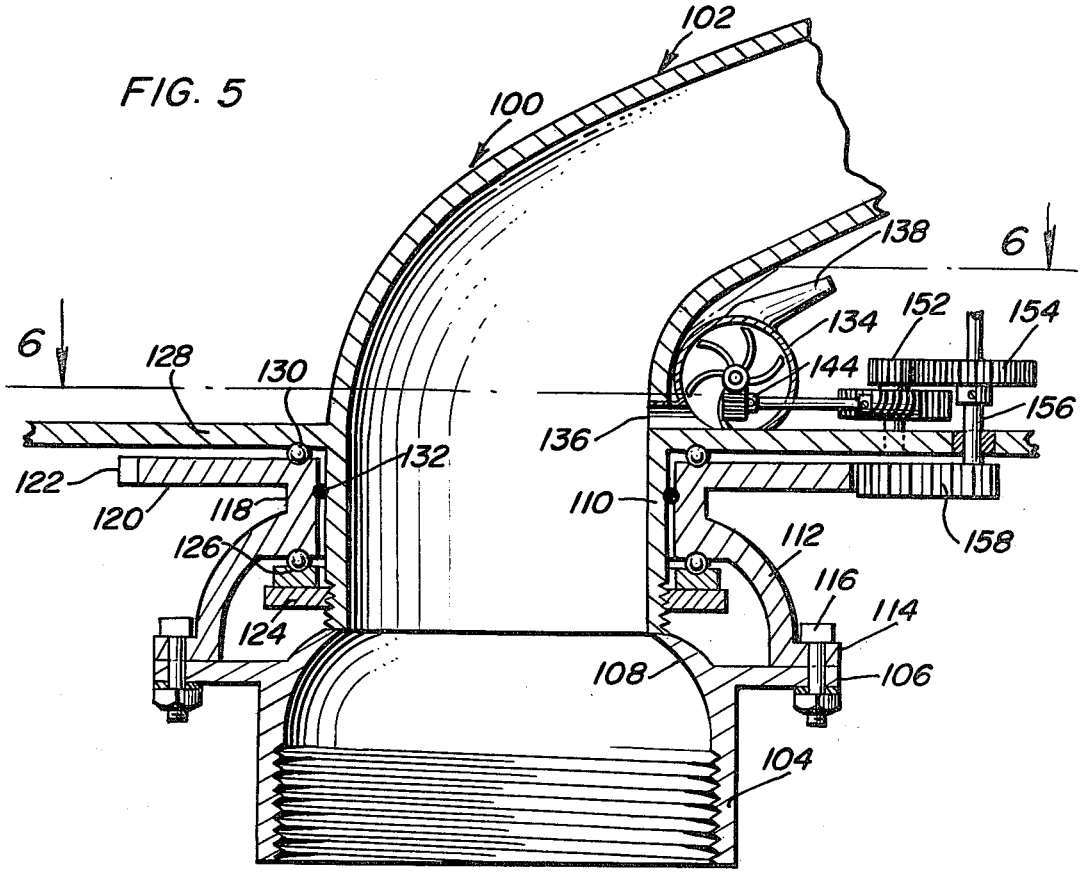
FIG. 5 is a sectional view of another embodiment of the invention, similar to FIG. 2, but illustrating the polygonal gear which is stationary with respect to the nozzle as an external gear.

Referring now specifically to FIGS 1–4, the irrigation sprinkler of the present invention is generally designated by reference numeral 10 and includes a nozzle generally designated by the numeral 12, a diffuser 14 at the outer end thereof, a rotatable support mechanism 16 and a water powered drive mechanism 18, all of which may be constructed of conventional materials and of a size commensurate with the volume of water to be discharged from the nozzle 12. The rotatable support structure 16 includes a pipe 20 which may be connected with a supply pipe (not shown) which may be above ground or below ground with the connection being conventional such as an internal threaded connection as shown, an external threaded connection or any other type of connection. The upper end portion of the pipe 20 flares outwardly into a generally upwardly facing bell-shaped arrangement 22 with the transition area between the pipe 20 and the bell-shaped area 22 including an entrance opening or throat 24 through which all of the water entering the sprinkler passes. Mounted on the upper end of the bell-shaped extension 22 of the pipe 20 is a flange 26 of circular configuration which may be either integral with the pipe or rigidly secured thereto in any suitable manner such as by welding or otherwise being fixedly secured thereto. Attached to the flange 26 is an internal gear 28 which preferably is removably attached to the flange 26 by suitable fasteners 30 or the like to enable removal of the gear 28 for interchange with other gears. The upper surface of the gear 28 is provided with a peripheral groove defining a bearing race 32 receiving a plurality of ball bearings 34 which are retained in circumferentially spaced relation by a retainer plate 36 which structure represents a conventional ball bearing assembly. All of the aforementioned components except for the ball bearings and the retainer are stationary with respect to the pipe 20 which is secured to the supply pipe or supporting structure.

The nozzle 12 includes a bell-shaped housing 38 which has a circular flange 40 at its lower end that includes a downwardly facing groove 42 forming a bearing race for receiving the ball bearings 34 thus rotatably supporting the flange 40 and housing 38 from the stationary gear 28. An O-ring seal 41 is positioned in facing grooves in flanges 26 and 40 to prevent water leakage. Extending upwardly from the housing 38 is an angulated discharge tube 44 having a pipe 46 detachably connected thereto. The outer and upper end of the pipe 46 is provided with a nozzle 48 of any suitable construction with the nozzle including the discharge opening or openings 50. The nozzle 48 may include a plurality of openings, slot-like openings or any other construction to distribute water equally of a predetermined trajectory which has a length so that it goes completely to the corner of an area being irrigated.

The diffuser 14 is a generally U-shaped member 52 which is inverted and pivotally attached to the nozzle 48 by a pivot pin or the like with downwardly curved extensions 56 being provided on the diffuser and extending to a point below the nozzle 48 and being connected to an actuating rod 58 to swing the diffuser from a position in alignment with the periphery of the discharge opening 50 to a broken line position as illustrated in FIG. 2 in order to deflect some of the water downwardly to reduce the trajectory of the path of movement of the water. Thus, when the diffuser 14 is in alignment with the nozzle 48 and the opening 50 therein, the water will travel a maximum distance whereas when the diffuser is in an angular position, the water will travel a less distance with the maximum distance being sufficient to have the water engage all of the land area to the corner of the area being irrigated while the maximum angular position will be such as to permit the water to pass only to the peripheral edge of the straight sides of the square or polygonal land area being irrigated. A deflector 53 is mounted in downwardly spaced relation to the inverted U-shaped member 52 in order to produce a downward thrust to counteract the upward thrust produced by water impinging on the undersurface of member 52 when in angular relation to the pipe 46.

The drive mechanism 18 includes a turbine or propeller 60 disposed in the throat 24 with the propeller being supported by a shaft 62 defining a vertical rotational axis so that as water passes through the throat 24, it will cause the propeller 60 and shaft 62 to rotate. The shaft 62 is journalled in a supporting spider 64 in the form of radially extending arms rigid with or integral with the flange 26 with the upper end of the shaft extending through and being journalled in a similar support spider 66 in the flange 40. The upper end of the shaft 62 is provided with a worm gear 68 which is in meshing engagement with a worm pinion 70 on a horizontal shaft 72 journalled in suitable bearing structure 74 attached to the spider 66. The other end of the shaft 70 is provided with a worm gear 76 in meshing engagement with a worm pinion 78 on a vertical shaft 80 journalled from the support spider 66. The lower end of the shaft 80 has a drive gear 82 mounted thereon with the shaft 80 being eccentric in relation to the center of the drive gear 82. The drive gear 82 is in meshing engagement with the internal gear 28 and the interior of the gear 28 includes inwardly offset linear portions 84 and outwardly of said linear portions 86 with the shape and configuration of the gear 28 being clearly illustrated in FIG. 3. Thus, as the shaft 80 is driven which rotates the eccentric gear 82 along with the shaft 80, the nozzle will be rotated about a vertical axis defined by the rotatably connected flanges 40 and 26. As the effective radius of the drive gear 82 changes, the teeth on the drive gear 82 and the stationary gear 28 remains meshed and the particular configuration of the inwardly and outwardly offset portions 84 and 86 of the gear 28 accommodate the change in radius of the gear 82 in relation to its rotational axis defined by the shaft 80. The change in the radius also varies the linear speed of the periphery of the gear 82 and correspondingly varies the speed of rotation of the nozzle 12 so that as the gear 82 passes an inwardly offset portion 84 of the gear 28, the nozzle 12 will rotate at a relatively slower speed as compared to when the gear 82 in in meshing engagement with an outwardly offset area 86 so that water is discharged onto a corner area of a land area when the gear 82 passes over the portion 84 of the gear 28 and the straight side portions of the land area will be irrigated when the gear 82 passes over an outwardly offset portion 86 of the gear 28. The upper end of the shaft 80 is in the form of a hollow sleeve 88 having an open upper end and a radial notch 90 therein receiving a laterally extending arm 92 that is attached to the actuating rod 58 for the diffuser 14. The inner end of the radial arm 92 is in the form of a depending rod 94 received in the sleeve 88 so that in order to connect the rod 58 to the shaft 80, it is only necessary to drop the rod 94 into the hollow sleeve 88 with gravity retaining the offset arm 92 in the notch 90. Thus, as the shaft 80 and nozzle rotate, the rod 58 will cause corresponding pivotal movement of the diffuser 14 with this movement being synchronized so that the diffuser is in straight line condition when sprinkling the corner areas of a square land area and in an angulated position when sprinkling the straight side area so that the water will not be projected beyond the straight side edges of the square land area or the like.

Figure 6:
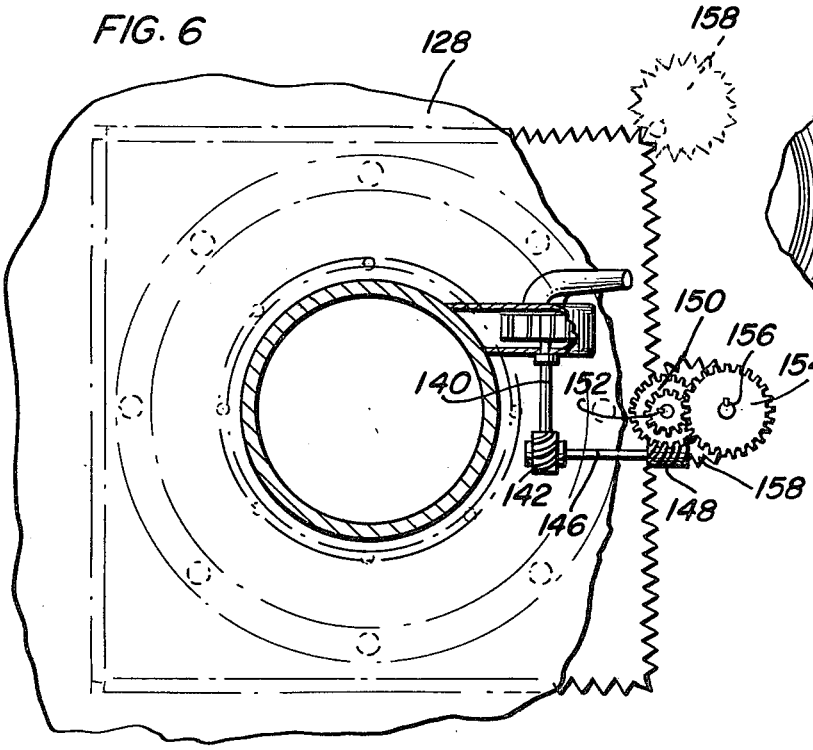
FIG. 6 is a transverse, sectional view taken substantially upon a plane passing along section line 6—6 of FIG. 5 illustrating further structural details of this embodiment of the invention.
Figure 7:
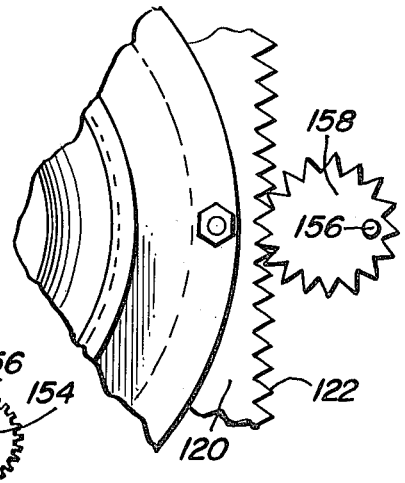
FIG. 7 is a fragmental plan view illustrating the association of the eccentrically supported gear and the external polygonal gear illustrating the structure when the nozzle is moving at its fastest rate.

Referring now to FIGS. 5–7, a second embodiment of the invention is disclosed which is designated generally by reference numeral 100 with the difference between this embodiment and that shown in FIGS. 1–4 being the structure for rotatably driving the nozzle at varying speeds. The nozzle structure and the pipe structure 102 leading to the nozzle as well as the diffuser structure is the same as that disclosed in FIGS. 1–4. The supporting assembly is slightly different and the drive mechanism is oriented externally of the flow path for the water thereby eliminating any obstructions to water flow.

An internally threaded pipe member 104 is attached to a standpipe, supply pipe or the like and includes a peripheral flange 106 adjacent its upper edge and an inwardly curved bell-shaped upper end portion 108 at the interior thereof for alignment with the lower end of a rotatable pipe 110 which forms a continuation of the angularly extending pipe and nozzle 102. Thus, water has an unimpeded flow into the pipe 110 and through the pipe and nozzle assembly 102.

Attached to the flange 106 is a bell housing 112 having a flange 114 secured to flange 106 by bolts 116 or the like. The bell housing 112 includes a short cylindrical portion 118 and a horizontal flange 120 having gear teeth 122 on the periphery thereof with the flange and gear teeth defining a square or other polygonal-shaped gear which is integral with the bell housing 112 and rigid with the pipe 104, thus remaining stationary during rotation of the pipe 110 and nozzle assembly 102. A retaining nut 124 engages the externally threaded lower end of the pipe 110 and a thrust bearing assembly 126 is interposed between the nut 124 and the upper interior of the bell housing 112 to retain the pipe 110 in position. The rotating pipe 110 includes a peripheral flange 128 rotatable therewith and integral therewith with a bearing assembly 130 being interposed between the flange 120 and flange 128 so that the two bearing assemblies 126 and 130 serve to rotatably secure the pipe 110 to the bell housing 112. The bearing assemblies 126 and 130 are conventional ball bearing assemblies with appropriate races and spacers or retainers in order to maintain the ball bearings in spaced relationship. An O-ring seal 132 may be provided between the exterior of the pipe 110 and the interior of the cylindrical portion 118 of the bell housing 112 to prevent leakage of water between the components.

The flange 128 supports a small turbine drive unit 134 having an inlet 136 communicated with the interior of the pipe 110 and a discharge nozzle 138 for discharging a small amount of water in the same general direction as the nozzle assembly 102. The turbine 134 includes an output shaft 140 having a worm gear 142 thereon in meshing engagement with a worm pinion 144 on a shaft 146 extending outwardly towards the periphery of the gear flange 120. The outer end of the shaft 146 is provided with a worm gear 148 driving a worm pinion 150 mounted on a common shaft with a small spur gear 152 in meshing engagement with a larger spur gear 154 mounted on shaft 156 journalled in the flange 128 and extending above the gear 154 for driving the diffuser in the same manner as in FIGS. 1–4. On the lower end of the shaft 156 below the flange 128, a drive gear 158 is mounted on the shaft 156 in eccentric relation thereto as illustrated in FIG. 7 with the gear 158 being in meshing engagement with the gear teeth 122 on the gear flange 120, thereby causing the eccentric gear 158 and the associated flange 128 and the pipe 110 and pipe and nozzle assembly 102 to all rotate as the gear flange 120 is stationary and the eccentric gear 158 rolls around the gear teeth 122 with the maximum radius of the eccentric gear 158 being when the gear 158 is at the center of the straight sides of the square flange 120 and the minimum radius of the gear 158 being when the gear 158 passes around the corner of the square gear 120 with the maximum radius being illustrated in FIG. 7 and the minimum radius being illustrated at the upper corner of FIG. 6. This device works in the same manner as that in FIGS. 1–4 and eliminates obstructions in the flow of water with only a minimal amount of water being used to drive the turbine with this water also being discharged in a fixed trajectory in relation to the land area being irrigated thereby effectively covering each increment of land area with an equal quantity of water.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An irrigation sprinkler comprising a discharge nozzle for discharging water at a substantially constant volume and velocity, means rotatably supporting said nozzle for movement about a vertical axis with the nozzle discharging water in a lateral path, and drive means rotating said nozzle at varying rotational speeds in each cycle of rotation for varying the quantity of water discharged along radial land areas extending from the axis of rotation as the length of the radial land areas varies when irrigating a non-circular land area, said nozzle including movable diffuser means, said diffuser means including an actuating mechanism drivingly connected with the drive means for the nozzle to vary the radial length of discharge of water corresponding to the rotational speed of the nozzle with the greatest radial length of discharge occurring when the nozzle is travelling at its slowest rotational speed.

2. The irrigation sprinkler as defined in claim 1 wherein said drive means for the nozzle includes a stationary gear, a rotatable drive gear, said drive gear being constantly meshed with the stationary gear, one of said gears being mounted on the housing and the other of said gears being mounted on the nozzle, and water powered drive means connected with the drive gear for rotating the drive gear at a substantially constant speed when water is being discharged from the nozzle, said stationary gear and said drive gear having offset peripheral portions whereby rotational movement of the gears will vary the rotational speed of the nozzle.

3. An irrigation sprinkler comprising a discharge nozzle, means rotatably supporting said nozzle for movement about a vertical axis with the nozzle discharging water in a lateral path, and drive means rotating said nozzle at varying rotational speeds in each cycle of rotation for varying the quantity of water discharged along radial areas extending from the axis of rotation as the length of the radial land areas varies when irrigating a square or other polygonal shape, said nozzle including diffuser means to vary the radial length of discharge of water corresponding to the rotational speed of the nozzle with the greatest radial length of discharge occurring when the nozzle is travelling at its slowest speed, said diffuser means including an actuating mechanism drivingly connected with the drive means for the nozzle, said support means including a housing adapted to be attached stationarily to a supply pipe, bearing means journalling the nozzle from the housing, said drive means for the nozzle including a stationary gear rigidly connected with the housing, a drive gear rotatably journalled on the nozzle, said drive gear being meshed with the stationary gear, and water powered drive means connected with the drive gear for rotating the drive gear at a substantially constant speed when water is being discharged from the nozzle, said stationary gear and said drive gear having offset peripheral portions whereby movement of the drive gear as it rolls around the stationary gear will move the nozzle at varying speeds, said drive gear being circular and mounted eccentrically on a shaft journalled from the nozzle with the variation in the effective radius of the drive gear corresponding with the variation in effective radius of the stationary gear to maintain meshing engagement between the gears.

4. The irrigation sprinkler as defined in claim 3 wherein said stationary gear is a polygonal-shaped external gear having outwardly extending teeth with the shape of the gear corresponding to the shape of the land area being irrigated with the corners of the gear being aligned with the corners of the land area.

5. The irrigation sprinkler of claim 4 wherein the water powered drive means includes water powered turbine means mounted on the nozzle and communicating with the water flow path through the nozzle.

6. The irrigation sprinkler of claim 3 wherein said stationary gear is an internal gear having inwardly extending teeth and inwardly and outwardly offset portions symmetrical about the center of the gear with the inwardly offset portions corresponding with the outside corner portions of the land area being irrigated.

7. The sprinkler as defined in claim 6 wherein the water powered drive means includes water powered turbine means mounted in the stationary housing in the flow path of water passing to the nozzle.

8. The irrigation sprinkler as defined in claim 3 wherein said diffuser means includes an inverted U-shaped member pivotally supported on said nozzle and movable between positions aligned with the nozzle and in angular relation to the nozzle as the nozzle rotates about its vertical axis, means connected with the nozzle drive means to move said member between its positions, and deflector means mounted on said U-shaped member in the water flow path to produce a downward force on the nozzle to counteract the upward force exerted on the nozzle when the member is in angular relation to the nozzle.

* * * * *